US006028569A

United States Patent [19]

Bassily et al.

[11] Patent Number: 6,028,569

[45] Date of Patent: Feb. 22, 2000

[54] HIGH-TORQUE APPARATUS AND METHOD USING COMPOSITE MATERIALS FOR DEPLOYMENT OF A MULTI-RIB UMBRELLA-TYPE REFLECTOR

[75] Inventors: Samir F. Bassily, Los Angeles; David G. Rodriguez, Mar Vista, both of Calif.

[73] Assignee: Hughes Electronics Corporation, El Segundo, Calif.

[21] Appl. No.: 08/888,485

[22] Filed: Jul. 7, 1997

[51] Int. Cl.[7] ..... H01Q 15/20

[52] U.S. Cl. ..... 343/915; 343/DIG. 2

[58] Field of Search ..... 343/915, 912, 343/916, DIG. 2

[56] References Cited

U.S. PATENT DOCUMENTS

| | | | |
|---|---|---|---|
| 3,541,569 | 11/1970 | Berks et al. | 343/915 |
| 4,575,726 | 3/1986 | Gounder | 343/756 |
| 4,682,475 | 7/1987 | Luly | 343/915 |
| 5,446,474 | 8/1995 | Wade et al. | 343/915 |

*Primary Examiner*—Don Wong
*Assistant Examiner*—Jennifer H. Malos
*Attorney, Agent, or Firm*—Georgann S. Grunebach; M. W. Sales

[57] ABSTRACT

An apparatus for deploying an umbrella-type structure such as an antenna reflector is provided. The umbrella-type structure includes a plurality of rib members movable from a stowed configuration to a deployed configuration. The deployment apparatus comprises a movable deployment tube and a hub pivotally attached to the plurality of rib members and slidably attached to the deployment tube. The hub is adapted to move along the deployment tube. The deployment apparatus further includes a plurality of rib deployment straps connecting the deployment tube to the rib members and a mechanism for moving the deployment tube in order to tension the rib deployment straps which in turn pull the rib members into the deployed configuration. The apparatus includes structural members made of composite materials, having a low (near zero) coefficient of thermal expansion, low density, and high strength. A method of deployment in accordance with the invention transitions through three distinct phases of deployment, continually providing high deployment torque consistent with the requirements for moving the inner rib members through nearly 90 degrees of travel, thereby permitting unassisted deployment of a large structure in a 1-G environment.

19 Claims, 7 Drawing Sheets

HIGH-TORQUE APPARATUS AND METHOD USING COMPOSITE MATERIALS FOR DEPLOYMENT OF A MULTI-RIB UMBRELLA-TYPE REFLECTOR

BACKGROUND OF THE INVENTION (a) Field of the Invention

The present invention relates generally to deployable structures, and specifically to systems for deploying umbrella-type reflectors for satellite antennae or similar satellite appendages.

(b) Description of Related Art

Deployment systems for satellite antennae reflectors such as umbrella-type reflectors typically include a hub mechanism for deployment. Such hub mechanisms typically include shafts, drive screws, hinges, linkages and mechanical stops, typically constructed of metallic materials. Such arrangements exhibit reduced thermal stability due to excessive coefficients of thermal expansion as well as a reduction of deployment repeatability. Known hub mechanisms are typically quite bulky (i.e., having a diameter of about ten percent of the overall reflector diameter) and rely on pyrotechnic devices for initiating deployment. Such pyro-technic devices present safety and reliability problems and require additional electronics for the control and actuation thereof. Pyro-technic devices also require extensive design and testing efforts to ensure that the antenna reflector structure can withstand loads associated with "pyro shock" and the resulting dynamic deployment motion which is difficult to analyze and/or simulate in a 1-G deployment environment (i.e., in a ground-based test). Pyrotechnics also require refurbishment after each use.

In addition, known hub mechanisms do not typically generate sufficient torque to deploy a reflector in a 1-G environment (e.g., for ground-based testing and evaluation). As a result, large and complex off-loaders are required for ground-based operation and testing of such hub mechanisms and the reflectors on which they are installed.

Accordingly, there is a need for a deployment system for satellite appendages, such as umbrella-type reflectors, that is configured so as to minimize or eliminate the aforementioned problems.

SUMMARY OF THE INVENTION

In accordance with one aspect of the present invention, an apparatus for deploying an umbrella-type structure comprises a hub and a plurality of inner rib members. Each inner rib member is pivotally mounted to the hub, and rotatable with respect to the hub between a stowed position and a deployed position. The apparatus further includes a plurality of flexible deployment straps operatively connected to at least one of the inner rib members. Each flexible deployment strap is adapted to rotate the inner rib member to which the flexible deployment strap is connected from the stowed position to the deployed position when the flexible deployment straps are placed in tension. The apparatus also includes a motor driven mechanism for tensioning the flexible deployment straps.

The apparatus uses the same motor driven mechanism to initially lock the inner rib members in a stowed configuration during launch, and then to commendably release the inner rib members, the deployment straps and deployment assist rods using the same mechanism motion.

The apparatus in accordance with the present invention may be constructed primarily of materials, such as graphite fiber reinforced plastic (GFRP) materials and KEVLAR® brand fabric materials (available from E. I. Du Pont de Nemours and Company, 1007 Market Street, Wilmington, Del. 19898), that have an extremely low coefficient of thermal expansion, enhancing the on-station performance of the reflector. The apparatus also incorporates special rib deployment termination and hinge pre-loading features which enhance the repeatability of deployment of the satellite appendage on which it is installed. The apparatus is a separately buildable, adjustable, and testable assembly, of a relatively small size compared to the reflector which it is capable of deploying.

The invention itself, together with further objects and attendant advantages, will be best understood by reference to the following detailed description, taken in conjunction with the accompanying drawings.

DESCRIPTION OF THE PREFERRED EMBODIMENTS

Figure 1:
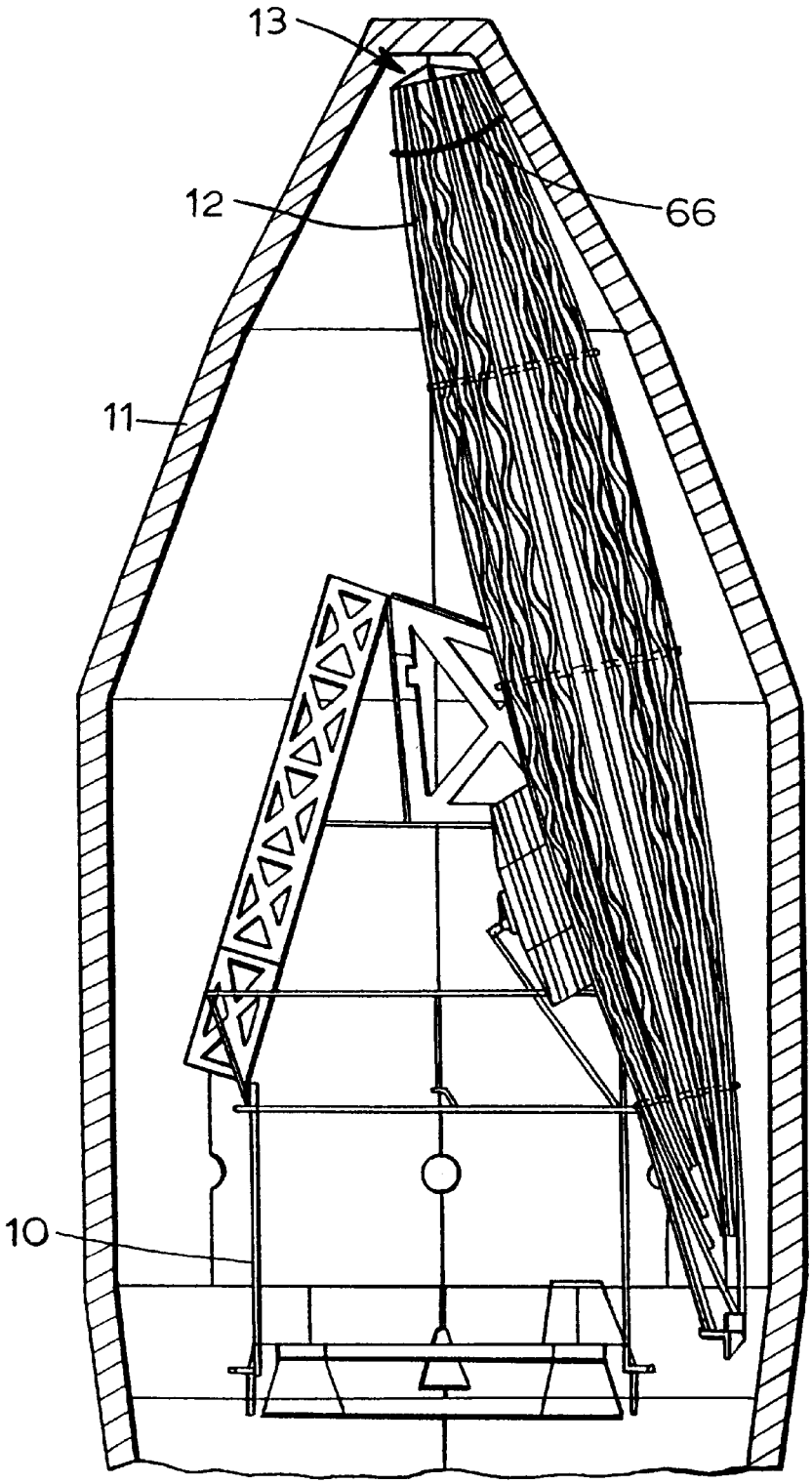
FIG. 1 is a side elevational view of a satellite having an antenna reflector including a deployment apparatus in accordance with the present invention, depicting the antenna reflector in a stowed position within a booster rocket fairing.

Referring initially to FIG. 1, a satellite 10 includes an umbrella-type antenna reflector assembly 12, shown in a stowed configuration in FIG. 1. In FIG. 1, the satellite 10 is shown stowed within a nose cone of a payload fairing 11 of a booster rocket (not shown).

Figure 2:
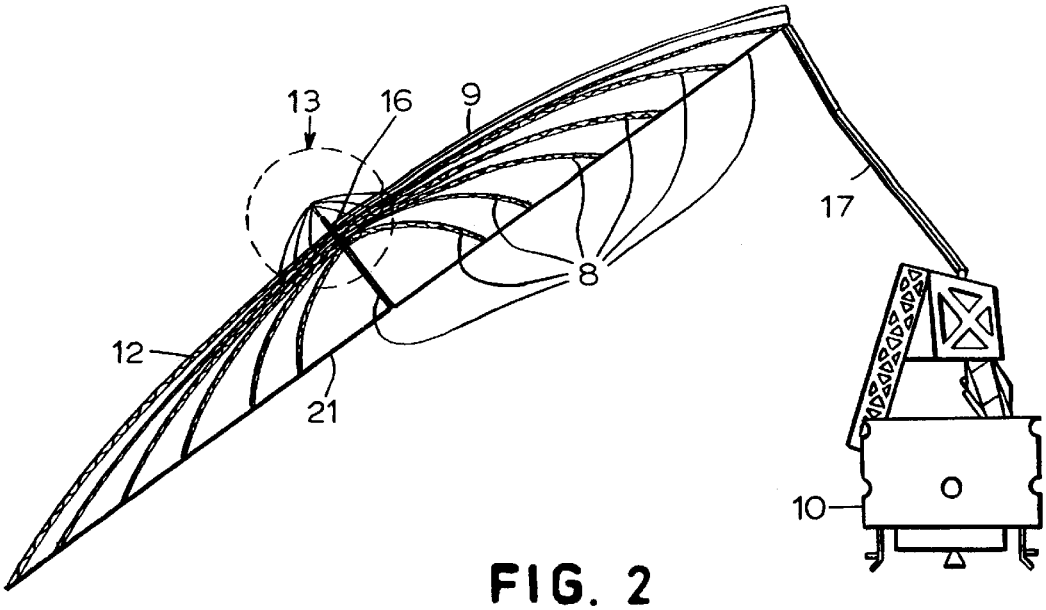
FIG. 2 is a side elevational view of the satellite of FIG. 1, depicting the antenna reflector in a deployed position.

FIG. 2 shows the antenna reflector assembly 12 in a deployed configuration, with a deployment apparatus 13 utilizing the present invention disposed generally in the center of the antenna reflector assembly 12. The antenna reflector assembly 12 includes a plurality of secondary rib members 8 (for example, thirty of the secondary rib members 8) and a main rib member 9. Each secondary rib member 8 is rigidly attached (e.g. by bonding) to an inner rib member 14, which is pivotally attached to a central hub 16, that is part of the deployment apparatus 13, and that is shown in greater detail in FIGS. 3 through 10. The main rib member 9 is rigidly attached (e.g. by bonding) to an inner main rib member 15, which is pivotally attached to the central hub 16. The main rib member 9 is attached at an opposite end to an articulated arm 17 that secures the antenna reflector assembly 12 to the satellite 10. The secondary rib members 8, the main rib member 9, the inner rib members 14, and the inner main rib member 15 are preferably constructed from graphite fiber reinforced plastic (GFRP) composite material (such as, for example, a material utilizing graphite cyanate ester resin).

Now referring to FIGS. 3, 5, 6, 8, and 10, the central hub 16 according to the present invention is slidably attached to a circularly cylindrical movable deployment tube 18, that is preferably constructed from GFRP composite material, by means of a pair of journal bearings 20, preferably lined with VESPEL® brand material (available from E. I. Du Pont de Nemours and Company). The central hub 16 is adapted to remain substantially perpendicular to the major axis 19 of the deployment tube 18 as the deployment tube 18 moves relative to the central hub. Although the deployment tube 18 is shown to be circularly cylindrical in shape, having a major axis 19, another appropriate geometry (such as, for example, an I-beam or box-beam) could be substituted therefor as a suitable deployment member.

The antenna reflector assembly 12 includes a reflector mesh 21. The reflector mesh 21 is the electrically reflecting surface and closely approximates the theoretical reflector surface of the antenna reflector assembly 12. The reflector mesh 21 is secured to each inner rib member 14, each secondary rib member 8, the main rib member 9, and inner main rib member 15.

The movable deployment tube 18 is rigidly attached to a central region of a base plate 22 (e.g., by bonding) at a first end 24 of the movable deployment tube 18. The base plate 22 is preferably constructed from GFRP composite material. Rotation of the movable deployment tube 18 about its major axis 19 with respect to the central hub 16 is prevented by a longitudinal key 23 (shown in FIG. 10) disposed on the outer surface of the movable deployment tube 18 that mates with a corresponding keyway 46 in each journal bearing 20. The movable deployment tube 18 is rigidly attached to a strap anchor plate 26 at a second end 27 of the movable deployment tube 18. The strap anchor plate 26 is preferably constructed from GFRP composite material.

Figure 8:
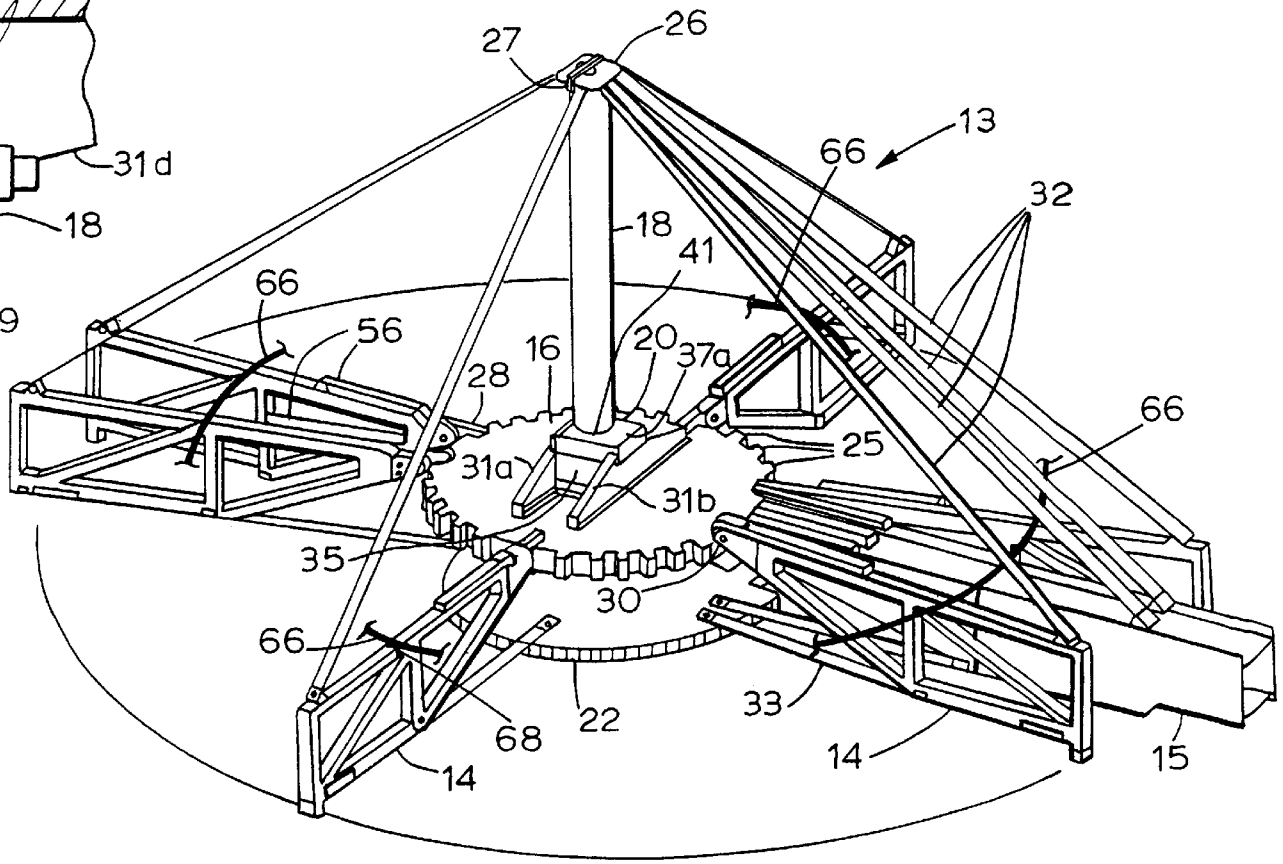
FIG. 8 is an isometric view of the deployment apparatus in a deployed configuration (for clarity, only structural elements associated with six of the inner rib members and the main rib member are shown in FIG. 8)

The central hub 16 is made of a thick honeycomb panel comprising two GFRP facesheets sandwiching a honeycomb core (e.g., a core made from NOMEX® brand honeycomb material, available from E. I. Du Pont de Nemours and Company). The central hub 16 has a shape similar to that of a gear wheel, having a plurality of teeth 25. A plurality of rib attachment hinge fittings 28, several of which are shown in FIG. 8, that are also preferably constructed of GFRP material, are bonded onto the teeth 25 (which provide shear surfaces for bonding) on the central hub 16.

Each inner rib member 14 is pivotally attached to one of the rib attachment hinge fittings 28 by means of a pair of pivot pins 30. The pivot pins 30 corresponding to each inner rib member 14 preferably pass through a pair of zero clearance monoball spherical bearings 29 bonded to each associated rib attachment hinge fitting 28, as shown in FIG. 6A. However, a self-aligning pre-loaded ball bearing (not shown) could be substituted for each zero clearance monoball spherical bearing 29. The two pivot pins 30 are connected together with a threaded stud 43 and locked in place with a pair of jam nuts 45. This arrangement permits rib assembly and disassembly despite the tight rib spacing on the central hub 16, thus allowing the minimization of hub diameter.

Figure 3:
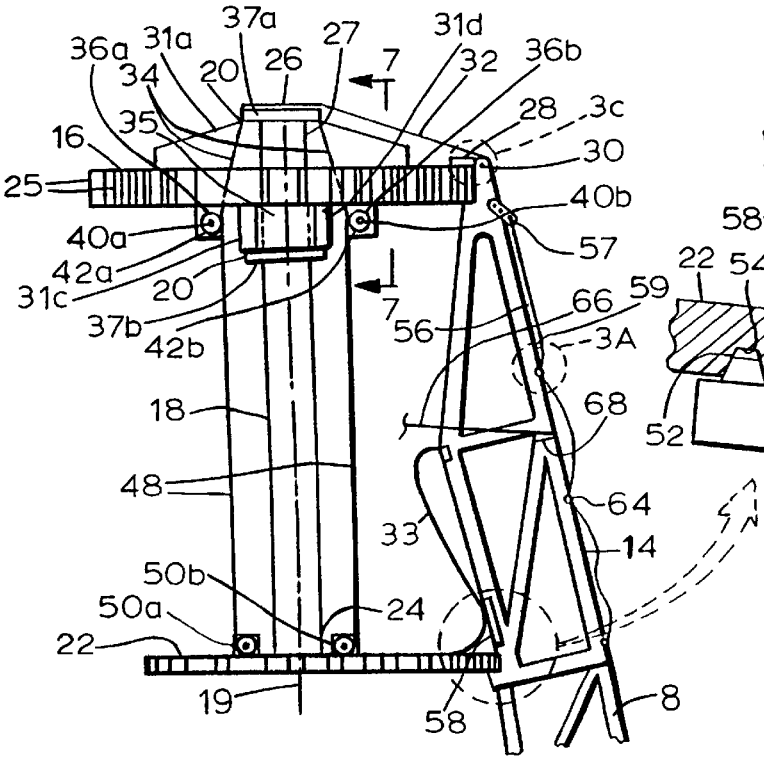
FIG. 3 is an enlarged fragmentary side elevational view of the deployment apparatus in accordance with the present invention, showing a single inner rib member of the antenna reflector in the stowed configuration.
Figure 4:
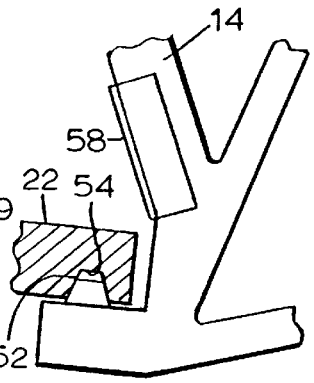
FIG. 4 is an enlarged fragmentary side elevational view of a portion of FIG. 3, partially in cross-section, showing a launch lock cone on one of the inner rib members and a mating launch lock indentation on a base plate portion of the deployment apparatus.

The central hub 16 is further stiffened by four substantially planar T-shaped stiffener panels, 31*a*, 31*b*, 31*c*, and 31*d* (two on either side of the central hub 16), each also made from a honeycomb panel comprising two GFRP facesheets sandwiching a honeycomb core, that are bonded to the central hub 16. The two T-shaped stiffener panels, 31*a* and 31*b*, that are disposed on the upper side of the central hub 16, as oriented in FIG. 3, are each symmetric about the major axis 19, and are disposed parallel to one another and are angularly offset by about 90° about the major axis 19, with respect to the two T-shaped stiffener panels, 31*c* and 31*d*, that are disposed on the lower side of the central hub 16. The two T-shaped stiffener panels, 31*c* and 31*d*, that are disposed on the lower side of the central hub 16 are each asymmetric in that each extends nearly to the periphery of the central hub 16 in the vicinity of the inner main rib member 15 in order to provide additional support to the central hub 16 in that region, although this asymmetry is not shown in the drawings.

The four T-shaped stiffener panels, 31*a*, 31*b*, 31*c*, and 31*d*, form a box-shaped member 35 near the center of the central hub 16 which in turn carries two bearing plates, 37*a* and 37*b*, that are substantially parallel to the central hub 16, and which each contain journal bearing members 41 (shown in FIG. 10 and preferably made of VESPEL® brand material) that together form the journal bearings 20.

With further reference to FIGS. 3 through 10, the strap anchor plate 26 is connected to a plurality of rib deployment straps 32, preferably made from a relatively pliant material (i.e., having a relatively low modulus of elasticity), such as low modulus GFRP, or KEVLAR® brand material, each attached to one of the inner rib members 14 (two rib deployment straps are attached to the inner main rib member 15). The base plate 22 is connected to each of the inner rib members 14 and to the inner main rib member 15 by a plurality of rib arresting straps 33, preferably made from a relatively stiff material (i.e., having a relatively high modulus of elasticity), such as GFRP.

Figure 3A:
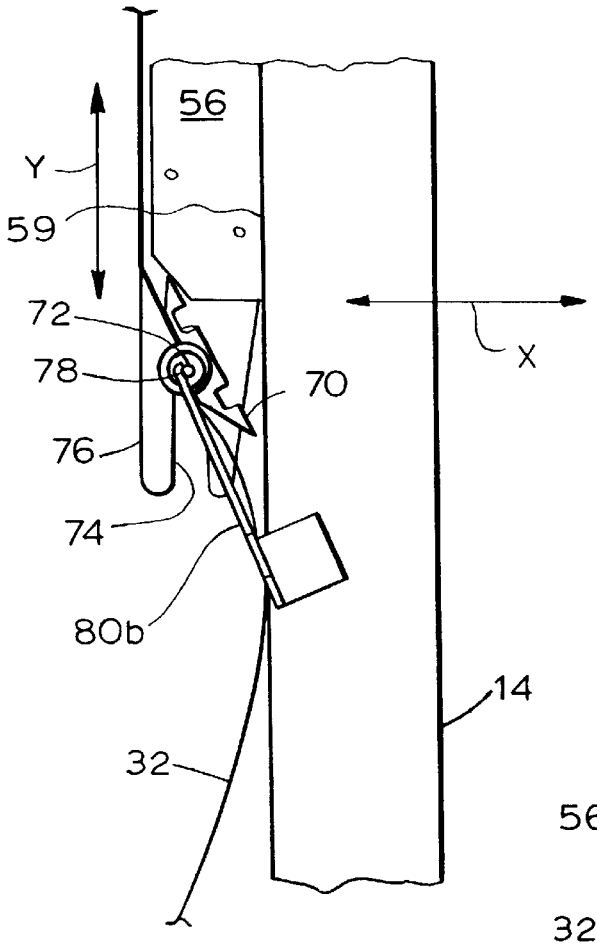
FIG. 3A is an enlarged partial side elevational view of portion of FIG. 3, showing an end of a deployment assistance rod, a portion of an inner rib member, and a connection apparatus for releasably connecting the deployment assistance rod to the inner rib member.
Figure 3B:
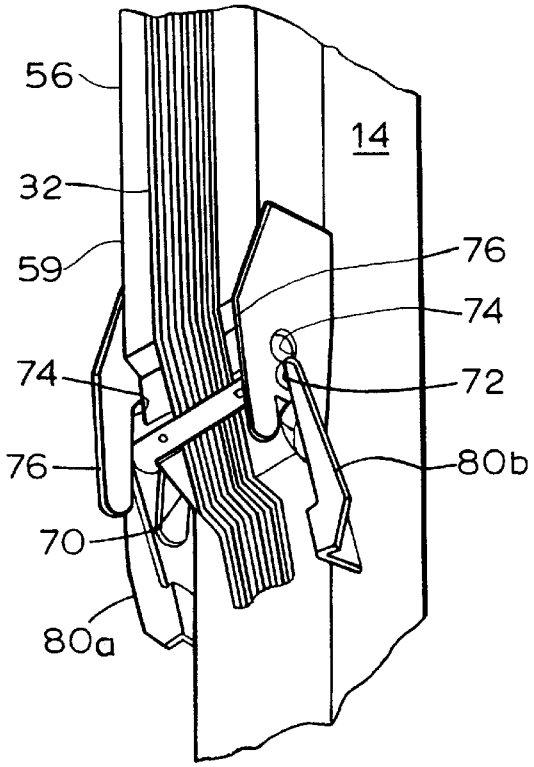
FIG. 3B is an enlarged partial isometric view of the structure shown in FIG. 3A.
Figure 3C:
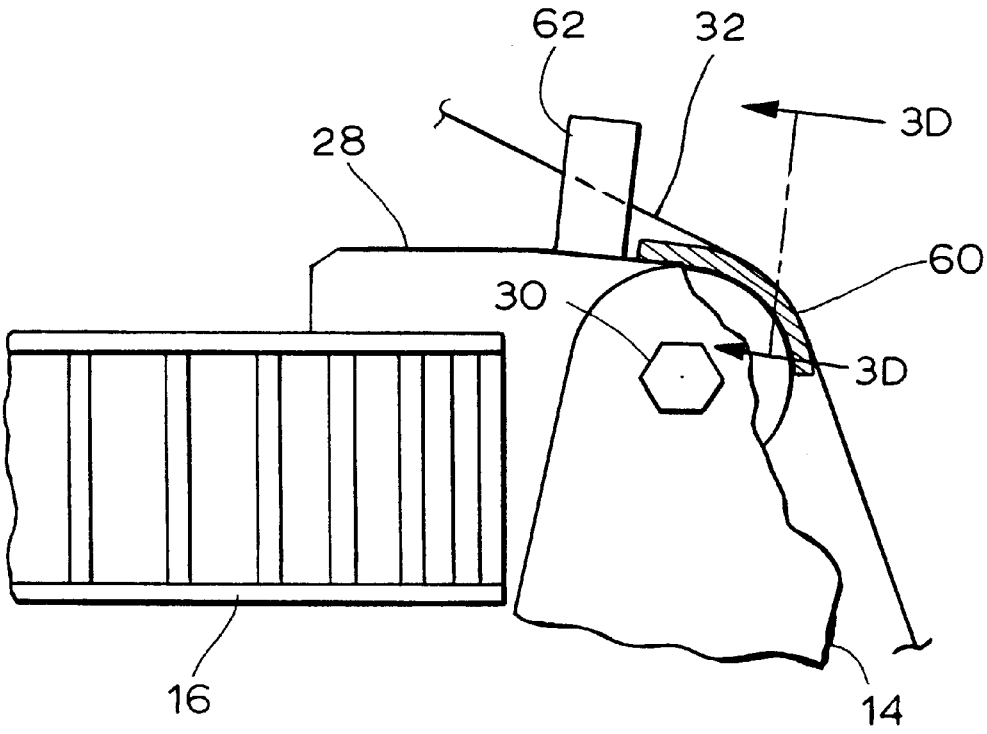
FIG. 3C is an enlarged partial side elevational view of a portion of FIG. 3, showing a rib attachment hinge fitting for joining an inner rib member to a central hub.
Figure 3D:
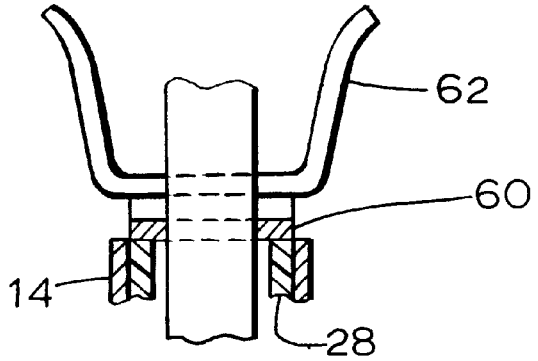
FIG. 3D is an enlarged partial elevational view, partially in cross-section, taken along lines 3D—3D of FIG. 3C.

As shown in FIG. 3C, each rib attachment hinge fitting 28 includes a curved strap guide 60 and a channel-shaped strap guide 62, both made from a thin aluminum sheet. The curved strap guide 60 and the channel-shaped strap guide 62 ensure that the rib deployment straps 32 do not get abraded or tangled as the deployment tube 18 moves to tension the rib deployment straps 32 during the deployment process. A launch lock cord 34, preferably made from a relatively pliant material, such as KEVLAR® brand material, fiberglass, or nylon, extends over the strap anchor plate 26.

Figure 7:
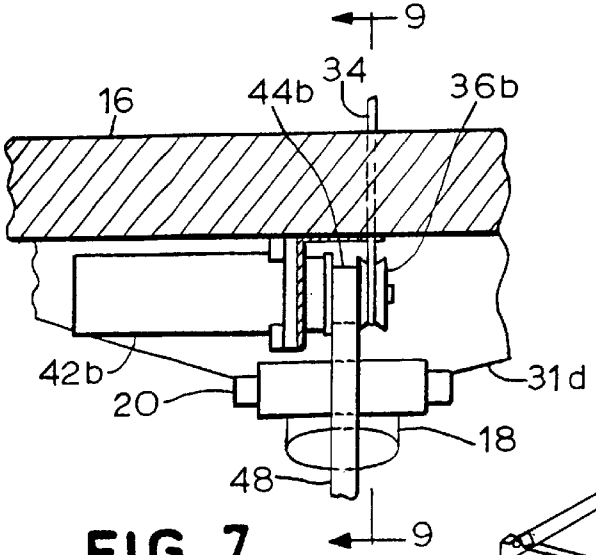
FIG. 7 is a fragmentary side elevational view, taken along lines 7—7 of FIG. 3, showing a deployment/locking drive stepper motor/gear head assembly in accordance with the present invention.
Figure 9:
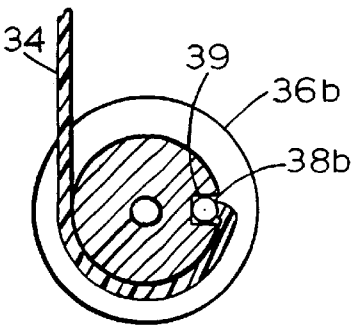
FIG. 9 is a cross-sectional view, taken along lines 9—9 of FIG. 7, of a launch lock winding pulley in accordance with the present invention.

When the antenna reflector assembly 12 is in the stowed configuration, the two ends of the launch lock cord 34 are each wrapped around a launch lock cord winding pulley 36*a* and 36*b*, respectively. The lock cord winding pulleys 36*a* and 36*b* are identical to one another. Accordingly, only the lock cord winding pulley 36*b* is shown in FIG. 7.

The ends of the launch lock cord 34 terminate in spherical beads 38*a* and 38*b* that are each engaged in a cylindrical bore 39 (FIG. 9) in each of the launch lock cord winding pulleys 36*a* and 36*b*. Accordingly, as each end of the launch lock cord 34 nearly completely unwinds from the respective launch lock cord winding pulley 36*a* or 36*b*, the spherical bead 38*a* or 38*b* will slide radially outwardly from the cylindrical bore 39.

Each launch lock cord winding pulley 36*a*, 36*b* is mounted to a drive shaft 40*a* and 40*b*, respectively, for rotation therewith. Each drive shaft 40*a* and 40*b* is driven by one of two electric deployment/locking drive stepper motor/gear head assemblies 42*a* and 42*b*, that each includes a multi-stage reduction gear head (not shown in detail).

Deployment strap winding pulleys 44*a* and 44*b* are also mounted to each drive shaft 40*a* and 40*b*, respectively, for rotation therewith. The deployment strap winding pulleys 44*a* and 44*b* are identical to one another. Accordingly, only the deployment strap winding pulley 44*b* is shown in FIG. 7. A deployment strap 48, preferably made from a relatively pliant material, such as KEVLAR® brand, fiberglass, or nylon fabric material, is securely anchored to and wound around each deployment strap winding pulley 44*a* and 44*b*, respectively, at either end of the deployment strap 48. As best seen in FIG. 3, the deployment strap 48 extends in a generally u-shaped path between the deployment strap winding pulleys 44*a* and 44*b* and passes around two guide pulleys, 50*a* and 50*b*, that are mounted to the base plate 22.

The deployment strap 48 is wound on the deployment strap winding pulleys 44*a* and 44*b* in a rotational direction opposite to the direction in which the ends of the launch lock cord 34 are wound around the launch lock winding pulleys 36*a* and 36*b*. Accordingly, as the deployment strap 48 is wound further onto the deployment strap winding pulleys, 44*a* and 44*b*, the launch lock cord 34 is loosened and, shortly thereafter, freed from the launch lock cord winding pulleys 36*a* and 36*b*.

Figure 5:
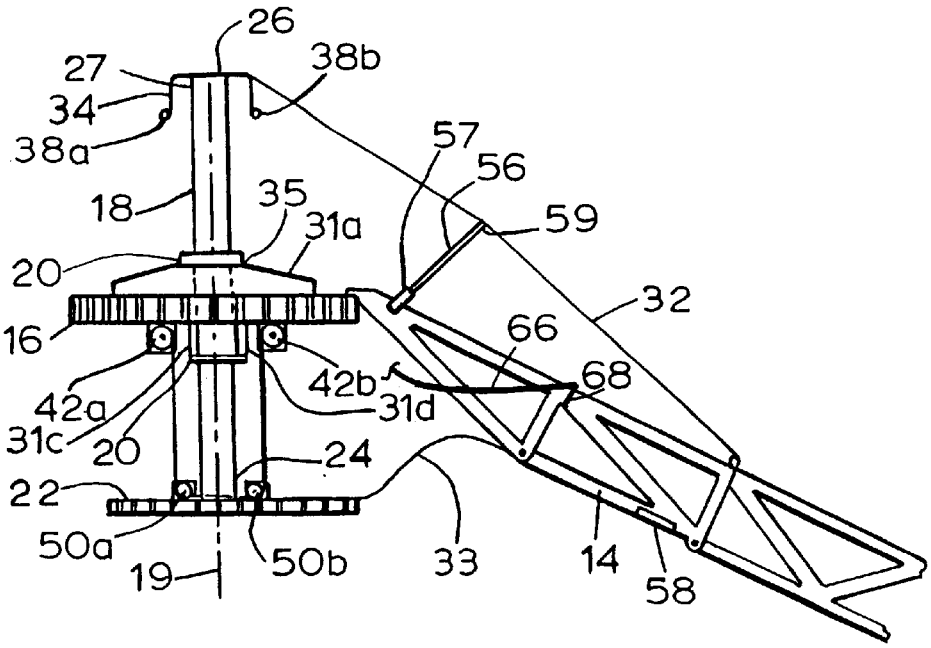
FIG. 5 is a fragmentary side elevational view, similar to that of FIG. 3, showing a single inner rib member of the antenna reflector in a partially deployed configuration.

As the deployment strap 48 is wound still further and tensioned by the continued actuation of the electric deployment/locking drive stepper motor/gear head assemblies 42*a* and 42*b*, the deployment tube 18 translates along the major axis 19 thereof, through the journal bearings 20 in the central hub 16, in an upward direction, as seen in FIG. 5, thereby creating tension in the rib deployment straps 32. Deployment assist rods 56, are each pivotally mounted at a first end 57 of each deployment assist rod 56 to each inner rib member 14 (two deployment assist rods 56 are pivotally mounted to the inner main rib member 15) and are each releasably mounted (as described in further detail below) at a second end 59 of each deployment assist rod 56 to each rib deployment strap 32. The tension in the rib deployment straps 32 pulls the deployment assist rods 56 and the rib deployment straps 32 away from the respective inner rib member 14 and the inner main rib member 15, thereby giving more leverage to the rib deployment straps 32 during a critical portion of the deployment process.

Figure 6:
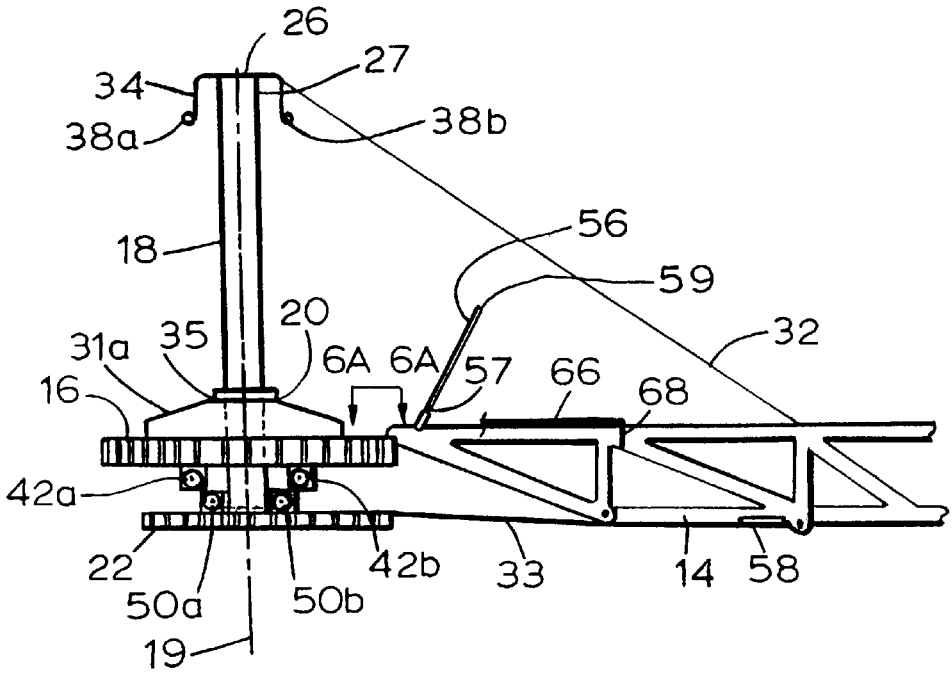
FIG. 6 is a view similar to FIG. 5, showing a single inner rib member of the antenna reflector in the deployed configuration.
Figure 6A:
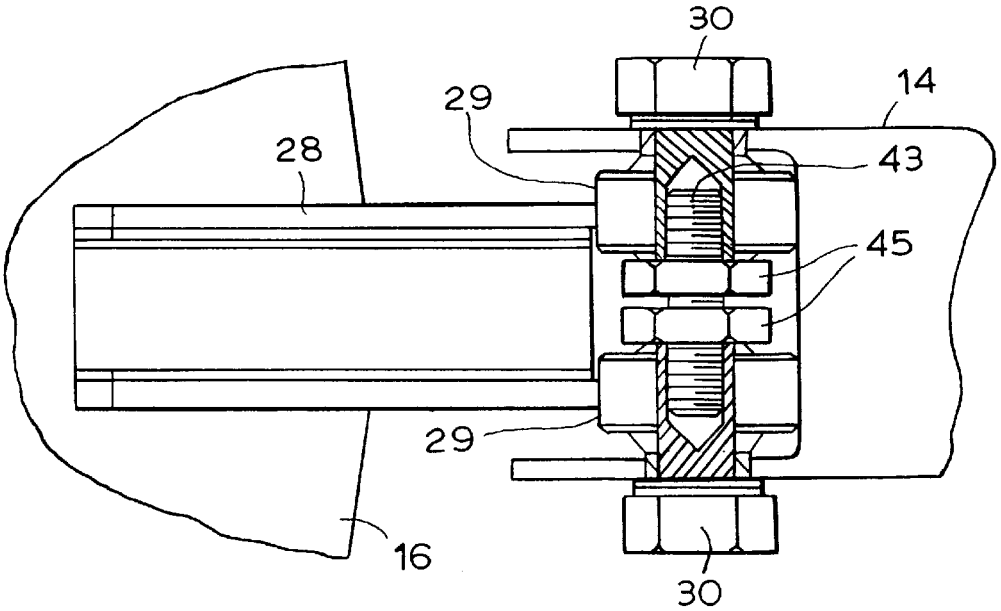
FIG. 6A is an enlarged partial plan view, partially in cross section, taken along lines 6A—6A of FIG. 6, showing a rib attachment hinge fitting for joining an inner rib member to a central hub.
Figure 10:
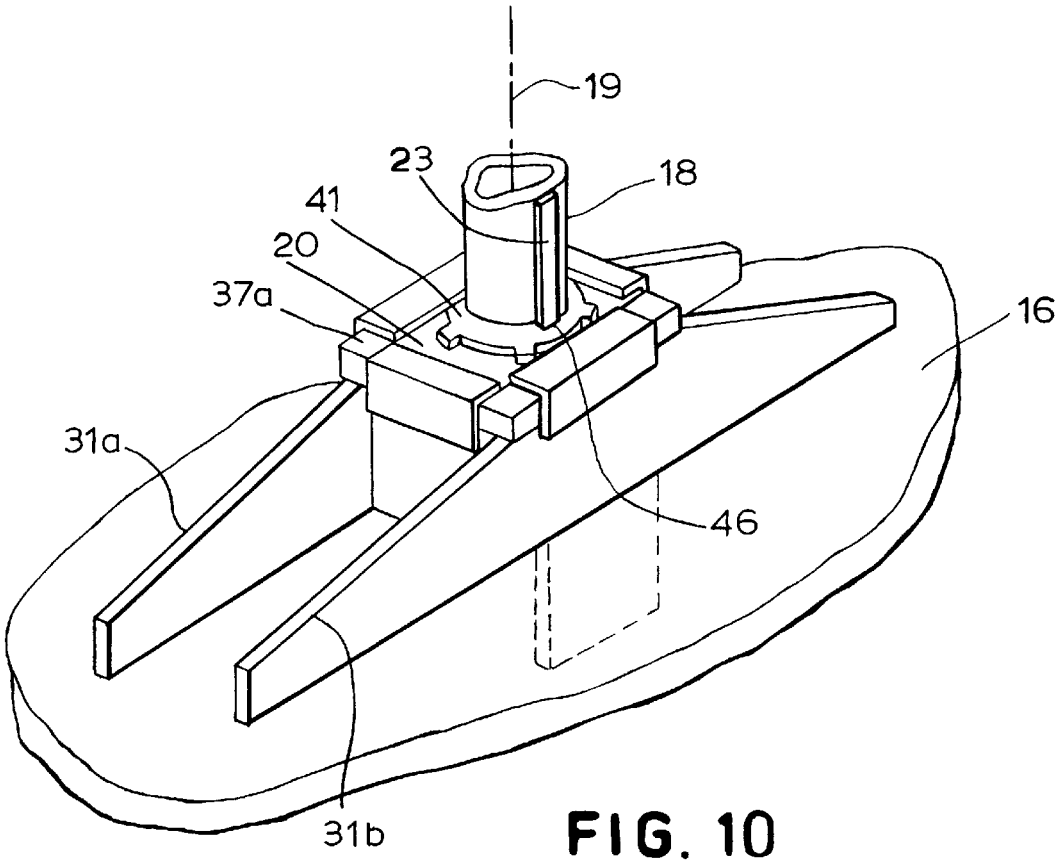
FIG. 10 is an enlarged isometric view, showing a pair of T-shaped stiffener panels, a central hub, a bearing plate, and a movable deployment tube, in accordance with the present invention.

Eventually, as the central hub 16 approaches a travel limit position along the movable deployment tube 18, the inner rib members 14 and the inner main rib member 15 reach a fully deployed configuration, as shown in FIG. 6, at which point the rib arresting straps 33 are taut and prevent further movement of the inner rib members 14 and the inner main rib member 15.

The inherent magnetic detent characteristic of each of the electric deployment/locking drive stepper motor/gear head assemblies 42*a* and 42*b* maintains tension on the launch lock cord 34 when the antenna reflector assembly 12 is in the stowed configuration (i.e., during ground handling and launch). The tension in the launch lock cord 34 is less than that necessary in order to back drive the electric deployment/locking drive stepper motor/gear head assemblies 42*a* and 42*b* against the magnetic detent characteristics thereof, thereby making the launch lock cord 34 a passive reliable launch lock design.

When under tension in the stowed configuration, the launch lock cord 34 maintains the deployment tube 18 in the stowed configuration, in a downward position, as shown in FIG. 3. When the deployment tube 18 is in this downward position, a launch lock cone 52 on each inner rib member 14, best seen in FIG. 4, engages a corresponding launch lock indentation 54 in the base plate 22, thereby restraining each inner rib member 14 from movement away from the base plate 22. Each launch lock indentation 54 is made from a dry-lubricated washer having a conical center hole that is bonded to the lower surface of the base plate 22 near the circumference of the base plate 22.

The deployment strap 48 effects the motion of the base plate 22 by passing through the two guide pulleys 50*a* and 50*b*, attached to the base plate 22 and symmetrically disposed relative to the major axis 19 of the deployment tube 18. The resultant deployment force applied to the deployment tube 18 is substantially equal to twice the tensile load in the deployment strap 48 and directed substantially along the major axis 19 of the deployment tube 18, even if the system has only one motor or if one side of a two motor system is not operating.

Each rib deployment strap 32 is secured to the corresponding inner rib member 14 and the inner main rib member 15 in a stowed position by hook-and-loop (e.g., VELCRO® brand) fasteners 64. A pair of elastomeric restoring bands 66 (FIGS. 1, 3, 5, 6, and 8), made of narrow strips of silicon rubber sheets, are secured to each inner rib member 14 and to the inner main rib member 15 using lacing tape 68.

The elastomeric restoring bands 66 are wrapped around the inner rib members 14 and the inner main rib member 15, as shown in FIGS. 1, 3, 5, 6, and 8, to maintain the inner rib members 14 and the inner main rib member 15 in the stowed configuration. The elastomeric restoring bands 66 prevent the possibility of the inner rib members 14 and/or the inner main rib member 15 racing ahead of the deployment tube 18 motion, or the deployment tube 18 racing ahead of the motion of the deployment strap 48. In addition, the elastomeric restoring bands 66 also produce a restoring moment about each pivot pin 30, tending to rotate each inner rib member 14 and the inner main rib member 15 to the stowed configuration. This allows the deployment process to be reversed if necessary by simply reversing the rotation of the electric deployment/locking drive stepper motor/gear head assemblies 42*a* and 42*b*. The restoring moment advantageously increases at the beginning of the deployment process, due to the elastic deformation of the elastomeric restoring bands 66, and diminishes to near zero toward the end of the deployment process, due to the decreasing effective restoring moment arm of the elastomeric restoring bands 66 as the inner rib members 14 and the inner main rib member 15 approach the fully deployed configuration.

As shown in FIGS. 3A and 3B, each rib deployment strap 32 has a radius plate assembly 70, attached thereto. Each radius plate assembly 70 includes a pin 72 that engages a radial slot 74, disposed in each of a pair of brackets 76 attached to each deployment assist rod 56. The pin 72 also engages a semi-circular notch 78 in each of two cantilever retention springs, 80*a* and 80*b,* that are attached to each inner rib member 14.

The cantilever retention springs, 80*a* and 80*b,* are made from aluminum sheet having a thickness of about 1 mm. Each of the cantilever retention springs, 80*a* and 80*b,* are oriented such that they are capable of resisting loads in a direction perpendicular to the lengthwise dimension of the inner rib member 14 to which they are attached (i.e., along the axis labeled "X" in FIG. 3A), in order to restrain the deployment assist rods 56 and the radius plate assembly 70 against high launch acceleration loads. However, the cantilever retention springs, 80*a* and 80*b,* exhibit low capability to resist loads in a direction along the length of the inner rib member 14 to which they are attached. (i.e., along the axis labeled "Y" in FIG. 3A), in order to permit the second end 59 of each deployment assist rod 56 to move away from the associated inner rib member 14 or inner main rib member 15, as slack is taken up in the rib deployment straps 32 when the deployment shaft 18 starts to move as deployment commences. Each of the two rib deployment straps 32 attached to the inner main rib member 15 also has an attached radius plate assembly 70, and is releasably attached to a corresponding deployment assist rod 56 and releasably secured to the inner main rib member 15 by a similar cantilever spring arrangement (not shown) that is disposed on the upper surface of the inner main rib member 15.

The deployment of the reflector deployment apparatus 13 proceeds in three distinct phases as follows. In a first deployment phase, after the deployment tube 18 has moved a small distance (i.e., 1–2 millimeters) upwardly as oriented in FIG. 3, and the launch lock cones 52 begin to disengage from the corresponding launch lock indentations, the outer edge of the base plate 22 contacts the inner edges of the inner rib members 14 and the inner main rib member 15, on which are mounted reinforcing angle members 58, also made from GFRP material. As the deployment tube 18 and the base plate 22 continue to move upwardly, the outer edge of the base plate 22 acts as a cam-type surface and wedges the inner rib members 14 and the inner main rib member 15 outward. This cam-type action helps to overcome any initial "sticktion" (i.e., static friction) and helps to release any mesh management provisions that are used to protect the reflector mesh 21 from entanglement during launch.

The first deployment phase also provides a period of time during which the deployment assist rods 56 and the rib deployment straps 32 are released from their respective stowed positions, and slack in the rib deployment straps 32 is taken up by the motion of the deployment tube 18. Specifically, the upper portions of the rib deployment straps 32 (i.e., between the strap anchor plate 26 and the rib attachment hinge fittings 28) develop enough tension, due to the motion of the deployment tube 18, to dislodge each of the radius plate assemblies 70, attached to each rib deployment strap 32, from the corresponding cantilever retention springs 80*a* and 80*b*. Thus, the deployment assist rods 56 are thereby released and begin to deploy outwardly, away from the corresponding inner rib members 14 and the inner main rib member 15. Secondly, as the deployment tube 18 continues to move, the rib deployment straps 32 pull off from the hook-and-loop fasteners 64 attached to the corresponding inner rib members 14 and the inner main rib member 15.

Once the deployment assist rods 56 reach fully deployed positions (i.e., each substantially perpendicular to the corresponding inner rib members 14 and the inner main rib member 15), all of the slack in the rib deployment straps 32 is taken up by motion of the deployment tube 18. At this point, a second deployment phase begins.

The various components of the deployment apparatus 13 are proportioned such that, at the beginning of the second deployment phase, the rib deployment straps 32 are no longer in contact with the curved strap guides 60, and have moved sufficiently away from the pivot pins 30 (each constituting the axis of rotation of the respective inner rib members 14 and the inner main rib member 15) to develop enough torque to keep up with increasing torque demand encountered (in a 1-G environment) as the inner rib members 14 and the inner main rib member 15 are raised from an essentially vertical orientation (i.e., substantially parallel to the major axis 19) to about 20° from vertical. Over the subsequent 20° to 30° of rotation of the inner rib members 14 and the inner main rib member 15, the torque efficiency of the deployment apparatus 13 diminishes slightly, while the 1-G deployment torque requirements continue to rise. This results in an increased compressive load on the deployment tube 18 and an increase in required torque from the electric deployment/locking drive stepper motor/gear head assemblies 42*a* and 42*b*. In a zero-G environment, the deployment torque requirements are minimal during this stage of deployment, since the inner rib members 14 and the inner main rib member 15 are sufficiently far apart that entanglement of the reflector mesh 21 is not likely, yet not sufficiently close to full deployment to start tensioning the reflector mesh 21 and the associated components (not shown) by which the reflector mesh 21 is attached to the reflector assembly 12.

A third deployment phase starts when the rib deployment straps 32 become completely straight and the radius plate assemblies 70 commence moving outwardly from the radial slots 74 in the brackets 76 attached to each deployment assist rod 56. Thus, the deployment assist rods 56 are ineffective during the third deployment phase and the rib deployment straps 32 directly pull the inner rib members 14 and the inner main rib member 15 upwardly. The release of the deployment assist rods 56 from the rib deployment straps 32 ensures that the final deployed positions of the inner rib members 14 and the main rib members 15 are independent of the length, position, clearance in attach points, stiffness, or thermal expansion of the deployment assist rods 56.

Since the attachment points between each rib deployment strap 32 and the associated inner rib member 14 or inner main rib member 15 are continuously moving radially outward (relative to the pivot pins 30) and upwards (toward the plane defined by the pivot pins 30), the torque efficiency of the deployment apparatus 13 increases steadily during the third deployment phase. Thus, during the third deployment phase, the deployment apparatus 13 easily generates enough torque to tension the reflector mesh 21, the associated components (not shown) by which the reflector mesh 21 is attached to the reflector assembly 12, and the rib arresting straps 33. The deployment apparatus 13 also generates sufficient torque during the third deployment phase to overcome the slowly but steadily increasing torque requirements encountered in a 1-G environment near the end of the deployment process.

The third deployment phase ends when the reflector assembly 12 is fully deployed. At this point, the base plate 22 has moved to a location just behind the theoretical reflector surface approximated by the deployed reflector mesh 21, actually providing support for the central portion of the reflector mesh 21, and the rib arresting straps 33 become fully taut, thus acting as rib stops. With two straps (one of the rib deployment straps 32 and one of the rib arresting straps 33) loading each rib attachment hinge fitting 28, all hinge clearance is taken up and a repeatable contact point is established, regardless of the magnitude of the tension in either strap and/or any hinge "slop." Thus, deployment repeatability is significantly enhanced.

The motion of the deployment tube 18 is finally stopped when a set of two detents (not shown), fixed to the central hub 16, extend into appropriately placed holes (not shown) in the deployment tube 18, causing the electric deployment/locking drive stepper motor/gear head assemblies 42*a* and 42*b* to stall. The electric deployment/locking drive stepper motor/gear head assemblies 42*a* and 42*b* are then slightly backed-off to ensure that the full load from the reflector assembly 12 is carried by the detents rather than the electric deployment/locking drive stepper motor/gear head assemblies 42*a* and 42*b*. This ensures precision, long-term stability, and repeatability of the final geometry of the reflector assembly 12. Alternatively, it may be advantageous, in certain applications, to eliminate the detents and use telemetry or communication data to actively control the end point of deployment with the electric deployment/locking drive stepper motor/gear head assemblies 42*a* and 42*b*, thus allowing slight shape adjustability in the reflector mesh 21 on demand.

A number of factors must be considered when sizing the various components of an apparatus in accordance with the present invention. The diameter of the central hub 16 must be sufficiently large to accommodate, and permit assembly of, the rib attachment hinge fittings 28.

Furthermore, the length of the deployment tube 18 and the length of each inner rib member 14 must be sufficiently large to limit the strap, deployment motor and launch lock cone loads to be within reasonable limits. Also, the lengths of the deployment assist rods 56, as well as the mounting locations thereof on the inner rib members 14 and the inner main rib member 15, are particularly critical for optimizing the rib deployment strap and deployment shaft loads and in ensuring that the lengths of the upper segments of the rib deployment straps 32 (i.e., between the strap anchor plate 26 and the radius plate assemblies 70) are sufficient to permit full stowage of the deployment assist rods 56, yet short enough to ensure sufficient distance between the rib deployment straps 32 and the rib attachment hinge fittings 28 at the beginning of the second deployment phase (i.e., when all slack is taken up from the rib deployment straps 32).

Because the lengths, mass properties (e.g. total mass and moment of inertia) and deployment angles of the various ribs for a given antenna reflector will not necessarily be equal (i.e., for an offset reflector), the dimensions of the various components such as deployment assist rods 56, attachment points between the deployment assist rods 56 and the inner rib members 14, and the strap lengths may be different for different rib members on a single antenna reflector. Various parameters, such as the dimensions of the components, may be optimized to minimize the strap tensions, the deployment tube load, or a compromise between the two. Depending upon the various parameters, the deployment tube loads may peak near the beginning or at the end of the second deployment phase (in a 1-G environment). For manufacturing ease, it may be convenient to design all of the deployment assist rods 56 to have equal length, but vary the corresponding rib member attachment point locations and rib deployment strap lengths to account for the differing rib sizes and shapes.

The deployment apparatus 13 in accordance with the present invention is a compact design, allowing the stowage of the reflector assembly 12 within the usually un-utilized volume near the top of the nose cone of a payload fairing 11 of a booster rocket (not shown). The central hub 16 has a small diameter, e.g. about four percent of the diameter of the antenna reflector assembly 12. The movable deployment tube 18 stows almost entirely below the top of the inner rib members 14 (thus minimizing the stowed reflector length) and yet completely lies behind the theoretical reflector surface approximated by the deployed reflector mesh 21, thus eliminating any shadowing. The deployment strap 48, rib deployment straps 32 and rib arresting straps 33 all efficiently stow next to the inner rib members 14.

While the present invention has been described with reference to specific examples, which are intended to be illustrative only, and not to be limiting of the invention, it will be apparent to those of ordinary skill in the art that changes, additions and/or deletions may be made to the disclosed embodiments without departing from the spirit and scope of the invention. For example, a screw drive or rack-and-pinion mechanism could be used to move the deployment tube 18 from the stowed position to the deployed position.

What is claimed is:

1. An apparatus for deploying an umbrella-type structure from a stowed configuration to a deployed configuration, comprising:

a hub;

a plurality of inner rib members, each pivotally mounted to the hub, and rotatable with respect to the hub between a stowed position and a deployed position;

a plurality of flexible deployment straps operatively connected to at least one of the inner rib members, each flexible deployment strap being adapted to rotate the inner rib member to which the flexible deployment strap is connected from the stowed position to the deployed position when the flexible deployment straps are placed in tension; and means for tensioning the flexible deployment straps.

2. The apparatus of claim 1, wherein the tensioning means comprises a shaft, attached to an end of each flexible deployment strap, and movable with respect to the hub for tensioning the flexible deployment straps.

3. The apparatus of claim 2, wherein the shaft is made of graphite fiber reinforced plastic composite material.

4. The apparatus of claim 2, wherein the shaft has a major axis and the shaft is movable with respect to the hub in a translational direction along the major axis of the shaft.

5. The apparatus of claim 2, further comprising:

a base plate attached to the shaft, the base plate including indentations thereon; and one or more launch lock cones attached to at least one of the inner rib members, that are adapted to mate with the indentations on the base plate when the umbrella-type structure is in the stowed configuration.

6. The apparatus of claim 2, wherein the shaft is disposed between the inner rib members and does not substantially protrude above the top of the hub when the umbrella-type structure is in the stowed configuration.

7. The apparatus of claim 2, wherein the umbrella-type structure defines a theoretical reflector surface when in the deployed configuration, and the shaft is disposed completely behind the theoretical reflector surface when the umbrella-type structure is in the deployed configuration.

8. The apparatus of claim 1, further comprising means for separating the flexible deployment straps from the inner rib members.

9. The apparatus of claim 8, wherein the separating means comprises a deployment assist rod pivotally attached to at least one inner rib.

10. The apparatus of claim 9, wherein each deployment assist rod separates from the corresponding flexible deployment strap as the umbrella-type structure nears the deployed configuration.

11. The apparatus of claim 1, further comprising at least one flexible rib arresting strap adapted to prevent overextension of at least one of the inner rib members.

12. The apparatus of claim 1, wherein the hub is made of graphite fiber reinforced plastic composite material.

13. The apparatus of claim 12, wherein at least one inner rib member is made of graphite fiber reinforced plastic composite material.

14. A method for deploying an umbrella-type structure, having a movable member and a plurality of rib members pivotally mounted to a hub, from a stowed configuration to a deployed configuration, the method comprising the steps of:

pressing the movable member of the umbrella-type structure against a lower surface of at least one of the rib members, to spread the rib members apart from one another; and pulling on at least one of the rib members, to further spread the rib members apart from one another.

15. The method of claim 14, wherein the step of pulling comprises a step of pulling on at least one of the rib members with a flexible deployment strap.

16. The method of claim 15, wherein the step of pulling further includes a step of separating the flexible deployment strap from the rib member.

17. The method of claim 14, further including a step of arresting the movement of at least one of the rib members at a predetermined deployed position.

18. The method of claim 17, wherein the step of arresting comprises a step of arresting the movement of at least one rib member using a flexible rib arresting strap.

19. The method of claim 18, wherein the movable member comprises a plate member and the flexible rib arresting strap is attached to the plate member.

* * * * *